United States Patent [19]

Totten

[11] 4,104,081

[45] Aug. 1, 1978

[54] IN-LINE BOTTLE RINSER

[75] Inventor: Roger W. Totten, Littleton, Colo.

[73] Assignee: Adolph Coors Company, Golden, Colo.

[21] Appl. No.: 712,676

[22] Filed: Aug. 9, 1976

[51] Int. Cl.[2] ..... B08B 3/02; B08B 13/00

[52] U.S. Cl. ..... 134/23; 134/24; 134/25 A; 134/62; 134/68; 134/72; 134/83; 134/129; 134/132; 134/152; 134/153; 198/404; 198/417

[58] Field of Search ..... 134/23, 24, 25 A, 62, 134/68, 72, 83, 125, 126, 129, 131, 132, 144, 152, 153, 180, 34; 198/377, 404, 417

[56] References Cited

U.S. PATENT DOCUMENTS

| | | | |
|---|---|---|---|
| 2,634,737 | 4/1953 | Rowe | 134/126 X |
| 2,786,479 | 3/1957 | Dungfelder et al. | 134/72 |
| 3,583,544 | 6/1971 | Prodzenski | 134/68 X |

FOREIGN PATENT DOCUMENTS

| | | | |
|---|---|---|---|
| 1,218,702 | 1/1971 | United Kingdom | 134/68 |

*Primary Examiner*—Richard V. Fisher
*Attorney, Agent, or Firm*—Kyle W. Rost

[57] ABSTRACT

A bottle rinser having a linear path for carried bottles has closely spaced bottle carriers on a lug chain, the carriers receiving the bottles in upright position and being pivoted in a plane perpendicular to the path of chain movement to invert the bottles and carry them over rinse means, then slightly tip the bottles from fully inverted position to aid in draining, and finally being pivoted to restore the bottles to upright position for unloading. The carriers are of stamped and formed construction with an elastomer retainer for simple operation and allowing good bottle exposure for external rinse. Guide rods positioned near the lug chain control carrier pivoting. The rinse means includes a rotating manifold with floating nozzles in its edge, the nozzles being prevented from spraying as they pass under a seal ring during a part of the manifold's rotation, and the nozzles spraying as they follow the mouth of a passing inverted bottle during another part of the manifold's rotation, the manifold's rotation being synchronized with the movement of the lug chain.

16 Claims, 14 Drawing Figures

IN-LINE BOTTLE RINSER

BACKGROUND OF THE INVENTION

1. Field of the Invention

The invention relates to bottle rinsers of the kind conveying a succession of bottles past a rinse station. More specifically, the invention is an in-line bottle rinser that inverts the bottles, rinses them, and returns them to upright position without rotating the bottles about a wheel.

2. Description of the Prior Art

Bottles and jars have been rinsed by placing them on a conveyor, clamping them in a holder, and then inverting the holder and bottle by passing the holder around a wheel in a vertical plane. The bottle may be rinsed and drained in the inverted position, after which the holder passes around another wheel returning the bottle to upright position. The holder is typically attached to a chain, and when the holder carries a bottle, the bending of the chain is restricted to prevent the carried bottle from striking an adjacent carried bottle, or alternatively, the holders must be spaced widely to allow the chain to bend.

The bending path followed by bottles in prior art bottle rinsers often requires the use of multiple conveyors and complex means to conduct the bottles around the bends. Further, the wide spacing of bottle holders causes inefficiency in the rinser, which ideally is continuously spraying water. If the bottles cannot be close together, the rinser may either waste the rinsing liquid by spraying it between bottles or require complex means to control a synchronized intermittent spray.

SUMMARY OF THE INVENTION

The in-line rinser receives a supply of bottles from a bottle conveyor, and loading means places each bottle in a carrier attached to an endless chain. While the chain moves the carrier substantially in a straight line, the carrier is inverted by guide means. The bottle is then moved over a nozzle manifold wheel having nozzles on its circumferential edge. The wheel rotates in synchronization with the movement of the endless chain and the nozzles are allowed to spray rinse liquid through a spray arc that is a predetermined portion of each nozzle's annular path around the nozzle manifold wheel. A nozzle enters the spray arc as a bottle approaches the nozzle manifold wheel and follows the bottle over the wheel, constantly spraying rinse liquid into the bottle throughout the nozzle's travel through the spray arc. Other spray means may rinse the exterior of the bottle. Guide means then tilts the bottle carrier to aid draining and eventually returns the bottle to full upright position. Unloading means removes the bottle from the carrier, and a conveyor may carry the bottle away. The endless chain returns the empty carrier to the loading means to receive another bottle.

An object of the invention is to create a bottle rinser that has no bends in the path of a carried bottle. A bend free bottle path allows closer bottle spacing and lower machine speeds for a given production rate, thereby increasing each bottle's exposure to rinse liquid and increasing time for draining. The bottles in the present invention are carried in a substantially straight path and are inverted by pivoting the bottle carrier in a plane perpendicular to the path of the carried bottle.

Another object is to improve rinse action in a bottle rinser. The rinse liquid is sprayed into the bottle through a continuously varying angle as the bottle passes over a nozzle on a rotating manifold that moves the nozzle through an arc as it sprays into the bottle mouth. As the rinse liquid impinges on the interior sides and bottom of the bottle through a varying angle, it swirls and otherwise provides superior rinsing action in the bottle.

Another important object is to improve the efficiency of bottle rinsers. The close spacing possible with an in-line rinser allows slower chain speeds for a given production rate and also allows efficient use of rinsing equipment. A single nozzle manifold may have several nozzles spraying at the same time since passing bottles are closely spaced. In addition, the sprayed rinse liquid is aimed to enter the mouth of the bottle and follows the bottle mouth as the bottle moves over the manifold, making efficient use of the rinse liquid. When the bottle has passed beyond the effective spray arc of the manifold, the nozzle aimed at that bottle is sealed and will not again spray until aimed at an approaching bottle.

A further object is to create a bottle carrier that provides good bottle exposure during exterior rinse and also allows dependable loading and unloading of bottles. The carrier is free of mechanical springs and rollers and has an elastomer bottle retainer as its only part that grips the carried bottle. The remaining parts of the carrier are a stamped and formed portion that provides needed support for inverting the bottle. The stamped and formed portion also provides a durable surface for contacting the guide means and provides mounting means for attaching the carrier to the bottle carrying chain.

DESCRIPTION OF THE PREFERRED EMBODIMENT

Figure 1:
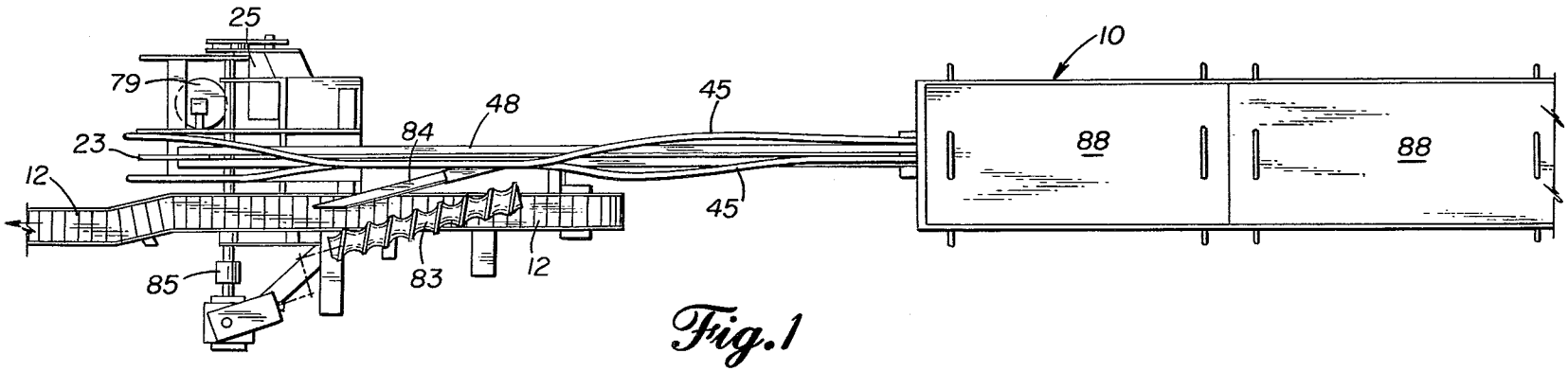
FIGS. 1 and 1A are a plan view of the rinser with the bottle carrying chain and carriers omitted for clarity.

In the embodiment shown in the drawings, the in-line rinser 10 may be used in combination with conventional bottle conveyors well known in the prior art. The view shown in FIGS. 1, 1A, 2 and 2A show the rinser in combination with conveyor 11 for bringing a supply of bottles in upright position to the rinser and a second conveyor 12 for receiving the rinsed bottles again in upright position and carrying them to other points.

The rinser comprises loading means near the end of conveyor 11, bottle carrying means attached to a bottle carrying chain that moves past the loading means to receive bottles 13, guide means for inverting the loaded bottle carrying means and returning the bottle carrying means to upright position, rinse means for impinging a jet of rinse liquid on the bottle's interior side and bottom walls at a varying angle, and unloading means near the beginning of conveyor 12 for removing the rinsed bottles from the bottle carrying means and guiding them onto conveyor 12.

Figure 3:
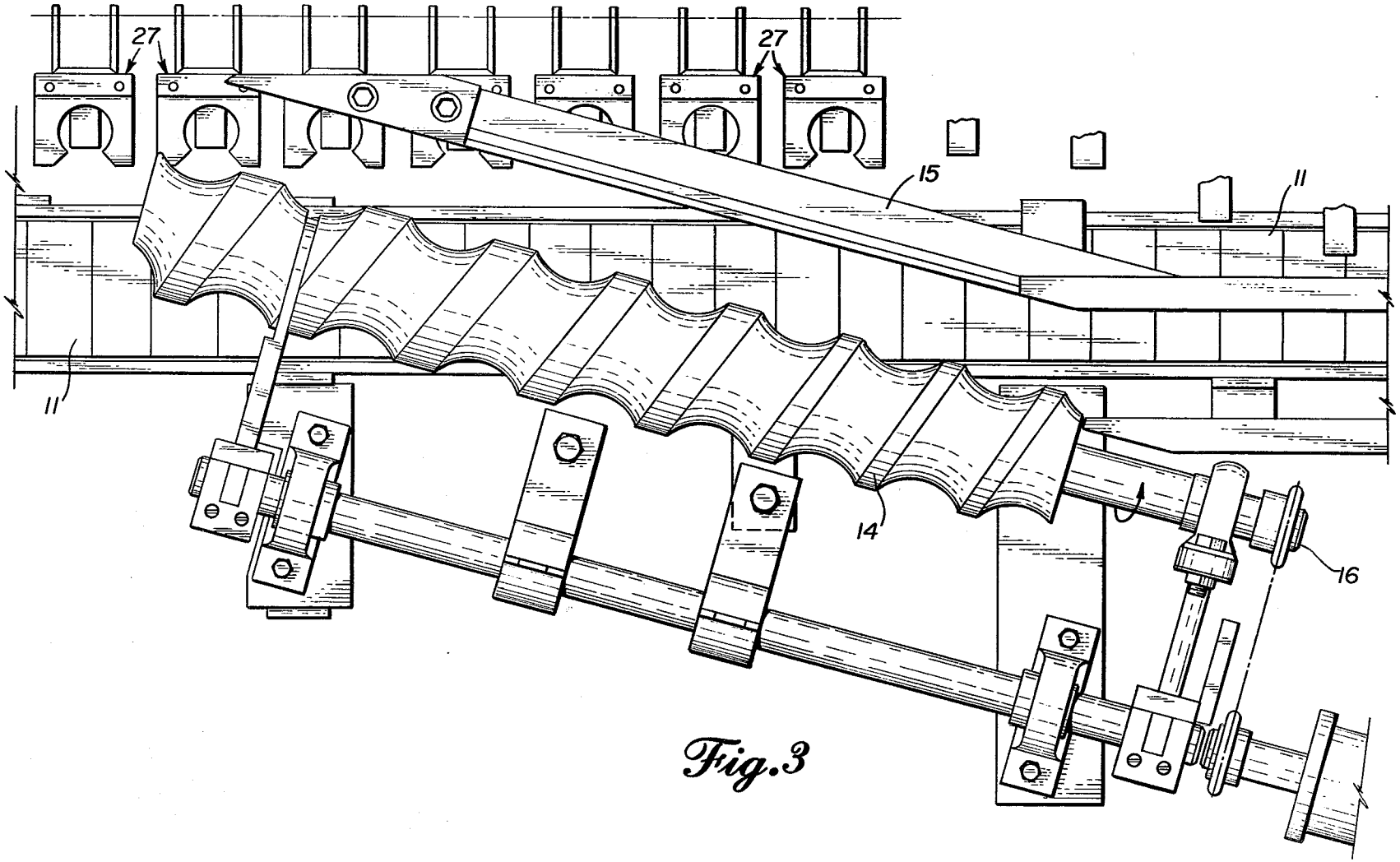
FIG. 3 is an enlarged plan view of bottle loading means.
Figure 4:
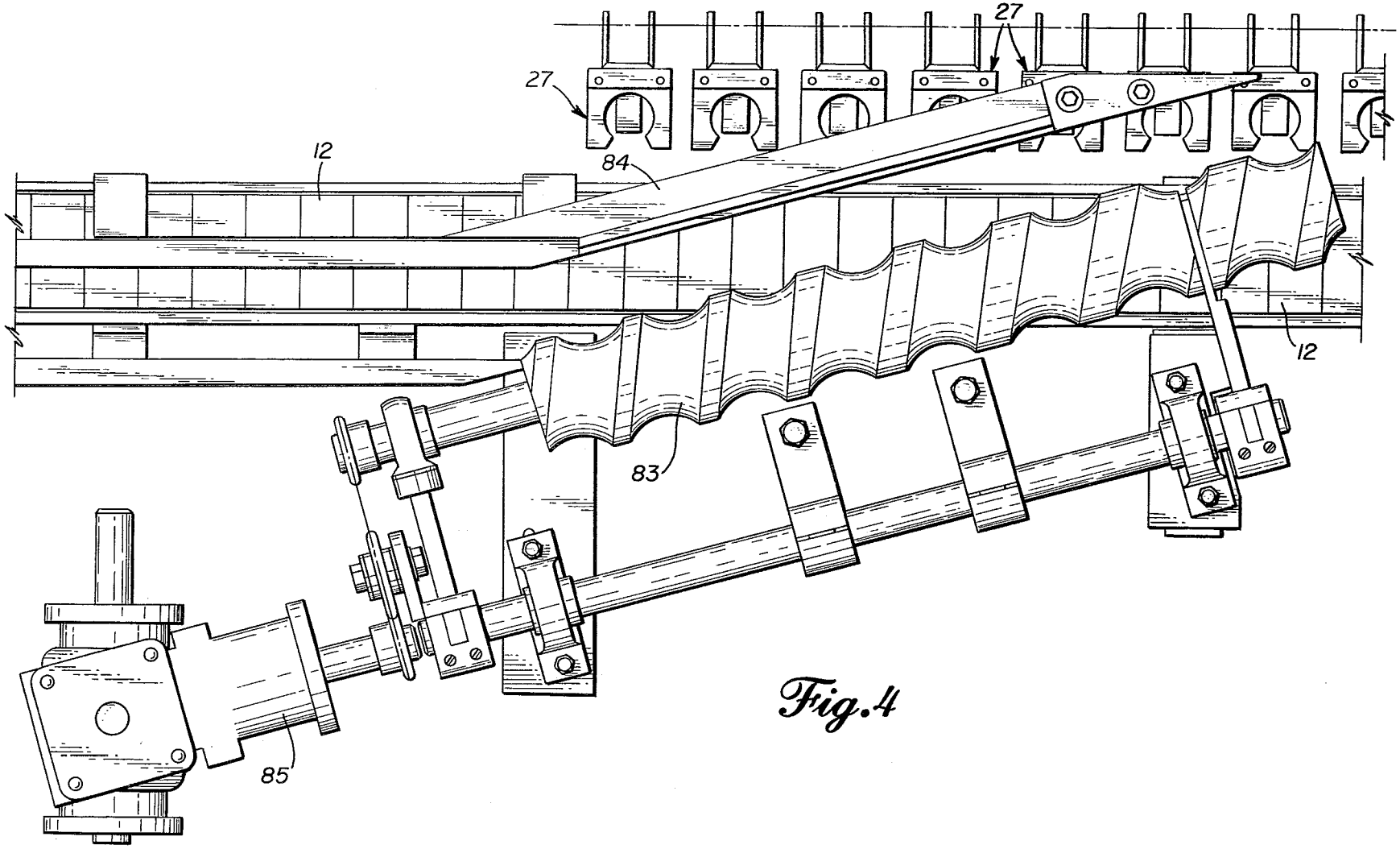
FIG. 4 is an enlarged plan view of bottle unloading means.

The preferred loading means as shown in FIG. 3 is a timing screw 14 synchronized to operate in coordination with the bottle carrying chain to assure that a bottle carrier is in position to receive each bottle fed through screw 14. A guide rail 15 assists screw 14 in removing bottles from conveyor 11 and transporting the bottles in upright position to the bottle carriers. Connecting means well known in the prior art, for example a mechanical system 16, synchronizes the timing screw with the movement of the bottle carrying chain.

Figure 11:
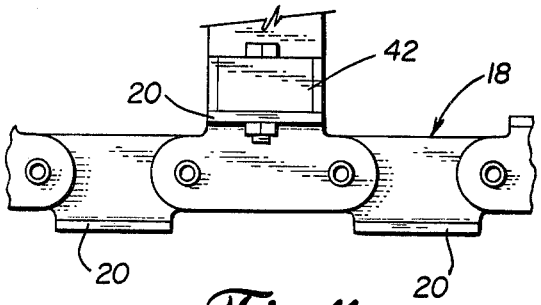
FIG. 11 is a side elevational view of the bottle carrying chain showing alternating lug positions on adjacent links.

The bottle carrying chain may be any variety of belt or cable, but the preferred variety is a lug chain 18 having lugs 20 alternating between top and bottom positions on adjacent links, as shown in FIG. 11. Chain 18 is endless and is carried by sprocket wheels 22 and 23 at opposite ends of rinser 10, shown in FIGS. 1, 1A, 2 and 2A. One of the sprocket wheels, for example wheel 23, is connected to drive means 25, providing power to move the chain 18 through the rinser and operate the loading and unloading means.

Figure 10:
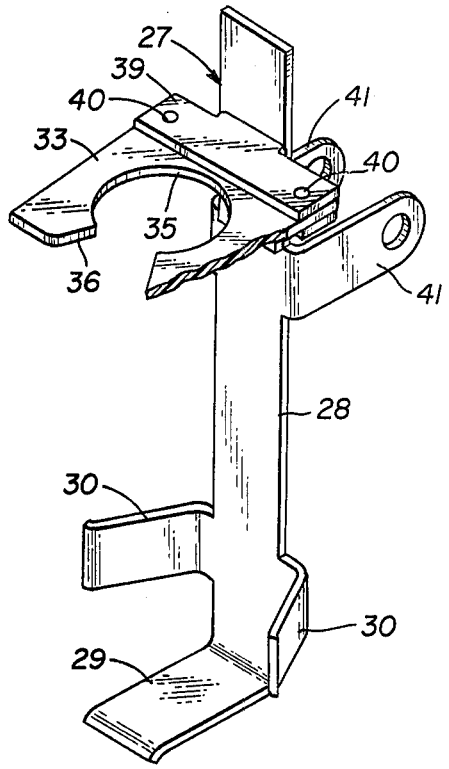
FIG. 10 is a perspective view of a bottle carrier.

The bottle carrying means attached to chain 18 is pivotally mounted in a plane perpendicular to the direction of motion of the chain. Guide means pivots the bottle carrier on its mounting as the chain linearly moves the carrier. The form of bottle carrier 27 shown in FIG. 10 is stamped and formed to cradle the lower part of the bottle without spring arms, rollers, or other mechanical action. The carrier has a lengthwise rear member 28 running parallel to the axis of the carried bottle, a bottom member 29 that contacts the lower edge of the bottle, and side arms 30 that are oblique to the plane of member 28 and provide lateral support at a point on each side of member 28. The member 28 is parallel to the vertical axis of the bottle, running between the bottom and mouth of the bottle. Arms 30 and bottom member 29 may have outwardly curved tips to aid in receiving bottles and to provide maximum exposure of the bottle surface to rinse liquid.

Figure 12:
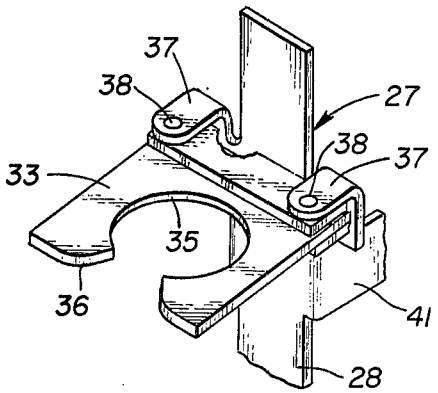
FIG. 12 is a perspective view of the bottle carrier showing a modified form of the connection between the stamped and formed portion and the retainer portion.

A bottle retainer 33 engages the neck of the carried bottle in its open center 35 when the bottle neck is forced through front opening 36 having a portion of the opening narrower than the diameter of the bottle's neck. It will be noted in FIGS. 5–9 that the retainer 33 engages the bottle between the bottom of the bottle and the mouth, the band immediately around the mouth often being referred to as the finish. The finish is shown in these figures to be uncovered by the retainer whether the bottle is upright, fully inverted, or in an intermediate position. Retainer 33 is preferably constructed of elastomer and is attached to the stamped portion of carrier 27 by mounting means, for example in FIG. 12 lug arms 37 may be a part of the stamped portion of carrier 27 and be attached to retainer 33 by fasteners such as rivets 38.

An alternative mounting means shown in FIG. 10 includes mounting bracket 39, which is attached to both retainer 33 and member 28 by fasteners such as rivets 40. Bracket 39 allows the retainer 33 to be repositioned for a different size of bottle by attaching the bracket at a different point on member 28. Retainer 33 is preferably attached to carrier 27 at an acute downward angle, for example 15 degrees from perpendicular to the axis of member 28, to provide a force urging the bottle heel into bottom member 29 and side arms 30 and retaining the bottle within the carrier as a whole during pivotal motion of the carrier. The height of retainer 33 relative to bottom member 29 and the angle of retainer 33 relative to member 28 may be varied for different bottle sizes or shapes, and the retainer 33 could be attached to member 28 by adjustable clamping means for modifying the rinser to accomodate various bottle sizes.

The entire carrier 27 may be attached to lug chain 18 by pivot arms 41 attached to a pivot block 42 by a pivot pin and cap screw assembly 43. The pivot block 42, in turn, is mounted on lugs 20 on the top of clain 18. As shown in FIGS. 6–9, the thickness of the pivot block allows the carrier 27 to pivot about chain 18 without interference. These figures also show that the bottle moves in and with the carrier in all positions of the carrier, the bottle thus maintaining a defined position with respect to the carrier as the bottle and carrier move together.

Figure 7:
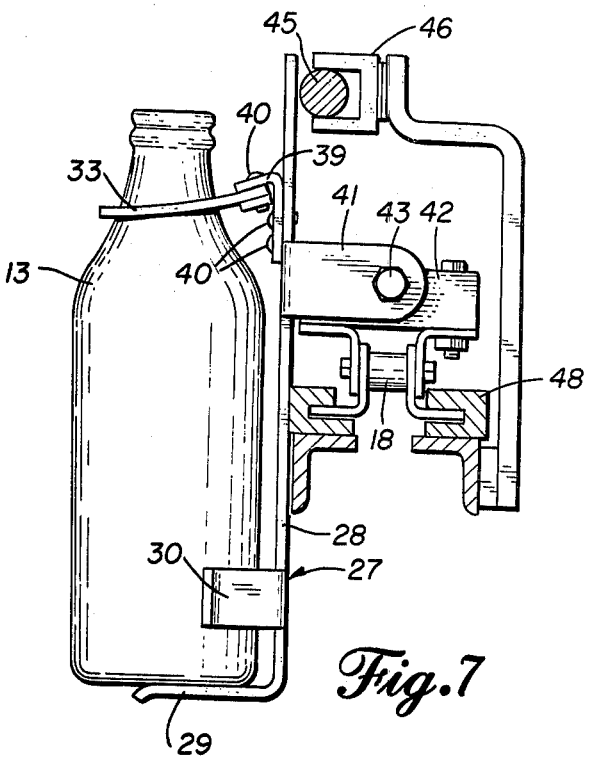
FIG. 7 is an elevational view showing the position of a bottle carrier and bottle just after the bottle enters the carrier.
Figure 8:
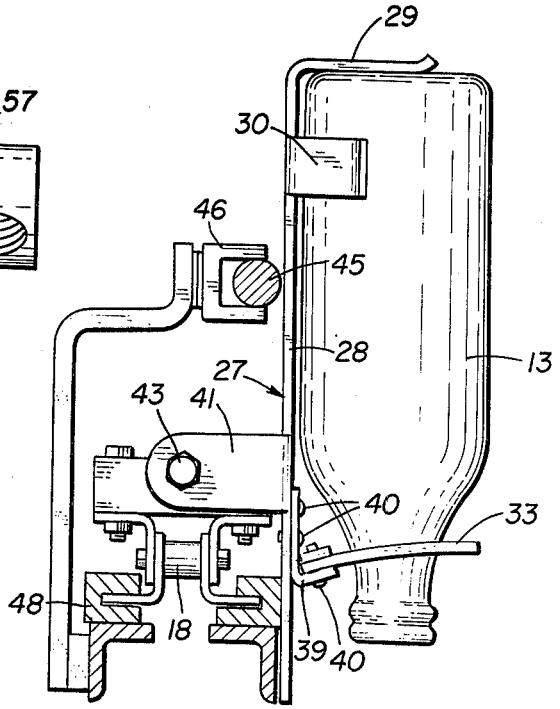
FIG. 8 is an elevational view showing the position of a bottle carrier and bottle while passing over the nozzle manifold.

The guide means controlling the pivoting of carrier 27 about chain 18 may be a pair of rods 45, preferably constructed of a plastic material, following the general path of chain 18 in spaced relationship and contacting the rear of carrier member 28 at two points, causing the carrier to pivot in response to the position of the rods. The rods 45 may be attached to the rinser 10 by swivel mounts 46 allowing the rods to be self aligning, each forming its own curve in a natural spiral or helical pattern. As the chain 18 moves the carriers 27 through the rinser, the carriers will pivot about the chain in response to the positioning of rods 45 with respect to the chain. For example, the carriers may be in upright position on a first side of the chain as shown in FIG. 7, or they may be in inverted position on a second side of the chain as shown in FIG. 8. To stabilize the chain 18 under the shifting weight of the pivoting carriers and bottles, the lugs 20 on the bottom of chain 18 may travel in track 48, which is preferably constructed of a plastic material to resist wear. As shown in FIGS. 7 and 8, the position of the carrier may be determined by one rod 45 plus the side of track 48 in some positions. In all instances the carrier and not the bottle is contacted by the rod or track to determine the position of the carrier.

Figure 5:
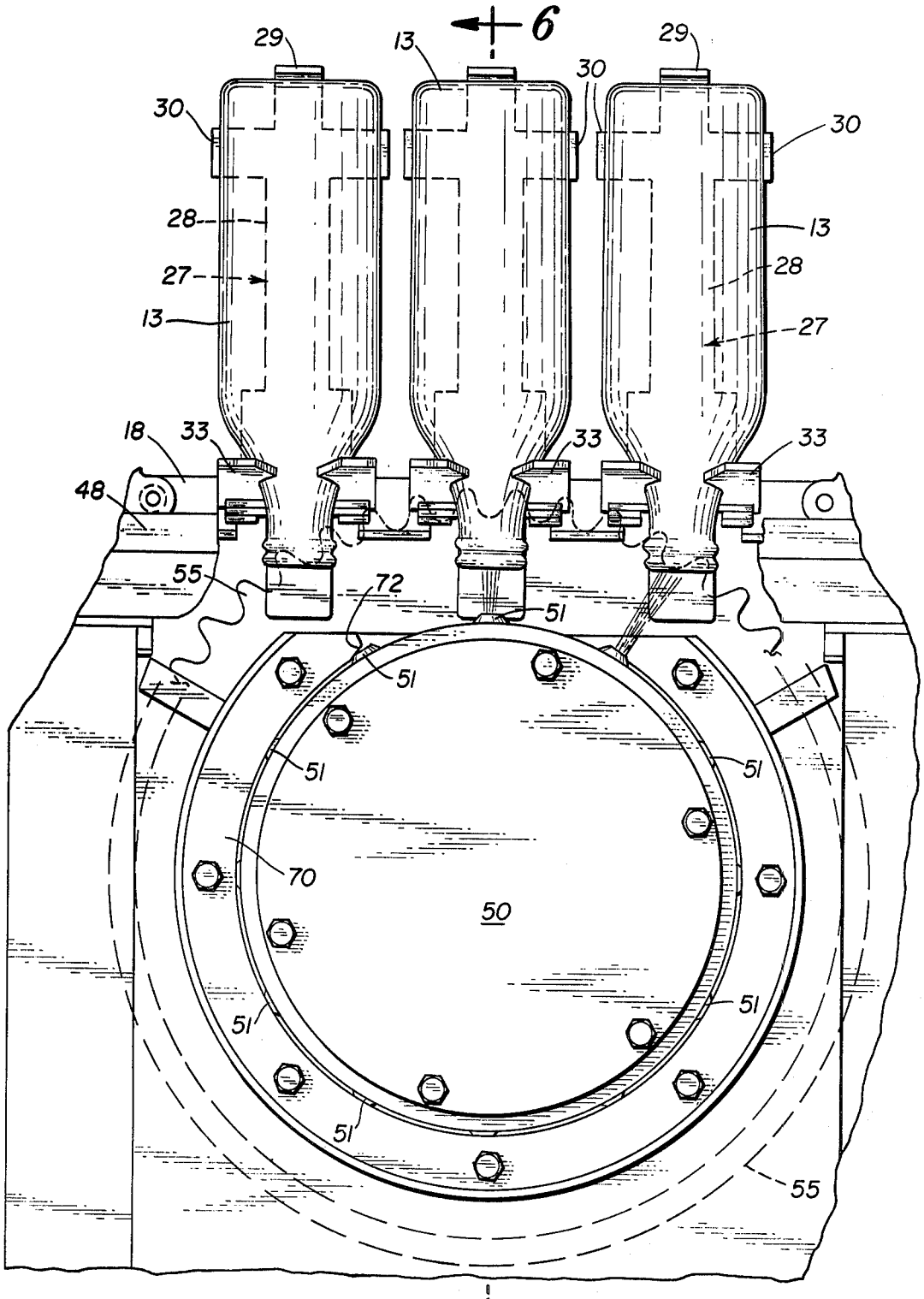
FIG. 5 is an enlarged side elevational view of a nozzle manifold with a series of bottles passing in carriers.
Figure 6:
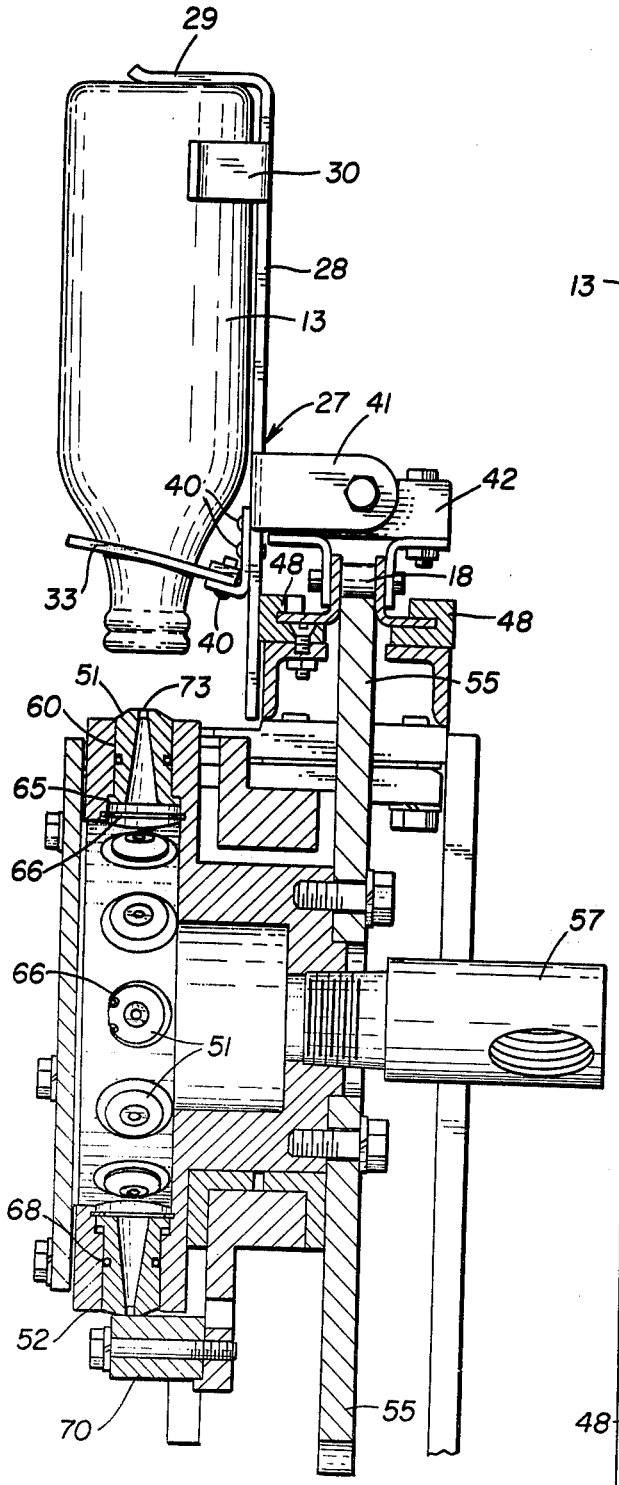
FIG. 6 is a sectional view taken along the plane of line 6—6 of FIG. 5.

As best shown in FIGS. 5 and 6, the rinse means may be a circular nozzle manifold 50 having a plurality of nozzles 51 set in its circumferential side 52. The manifold 50 is connected to means for rotating the manifold in synchronization with the movement of chain 18, for example cycloidal cut sprocket 55 that is tangentially driven by chain 18. Sprocket 55 and manifold 50 are coaxially mounted with rotating union 57, which is connected to a source of rinse liquid through supply hose 58. Each nozzle 51 is in a mounting bore 60 in which the nozzle may float. The inner end 65 of each nozzle is flanged to prevent the nozzle from moving too far outwardly in its bore in response to the pressure of rinse liquid in the manifold, and the inner end of each bore 60 has spring clip 66 preventing the nozzle 51 from moving too far inwardly. A seal 68 prevents leakage between mounting bore 60 and nozzle 51.

Nozzle sealing means such as stationary seal ring 70 surrounds much of side 52 of manifold 50 and defines a nonspray arc of, for example, 300 degrees. A portion of side 52 is not covered by seal ring 70 and is defined as a spray arc of, for example, 60 degrees. As the rinser operates, chain 18 drives sprocket 55, which turns nozzle manifold 50. As the nozzles travel through the nonspray arc under seal ring 70, they are blocked from spraying, but as they enter the spray arc they expel a jet of rinse liquid continuously until rotated again under seal ring 70. While the nozzles travel through the spray arc, the pressure of rinse liquid in manifold 50 pushes the floating nozzles outwardly, but the beveled edge 72 at the start of seal ring 70 urges each nozzle inwardly into its bore 60 so that each nozzle fits snugly under the seal ring and is self-adjusting for wear. In addition, each nozzle has seal ring contact face 73 that includes the nozzle orifice and surrounding portion of the nozzle end that directly contacts the nozzle sealing means, as shown in FIG. 6. The projected area of flanged end 65 is greater in area than the nozzle's seal ring contact face 73, thereby making the nozzles self-sealing against the seal ring in the nonspray arc.

Figure 2:
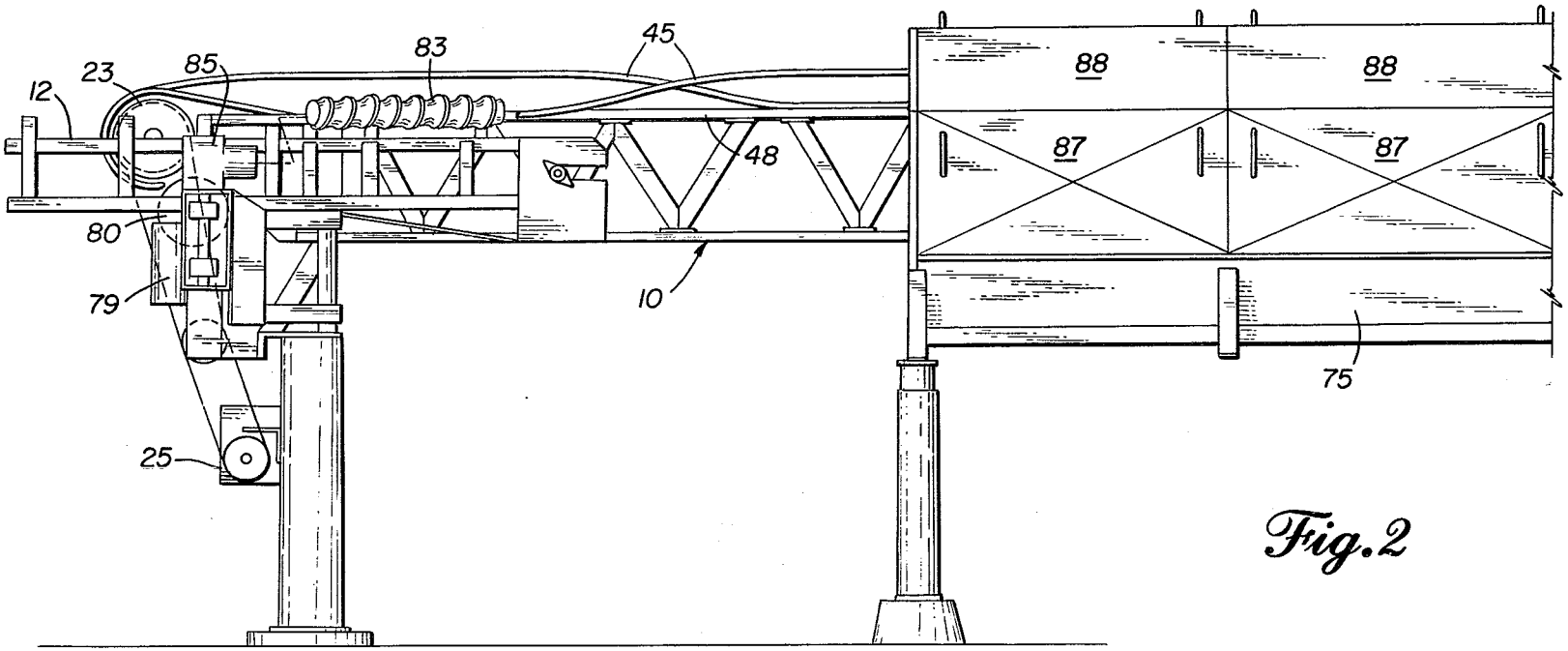
FIGS. 2 and 2A are a side elevational view of the rinser as shown in FIGS. 1 and 1A.
Figure 1A:
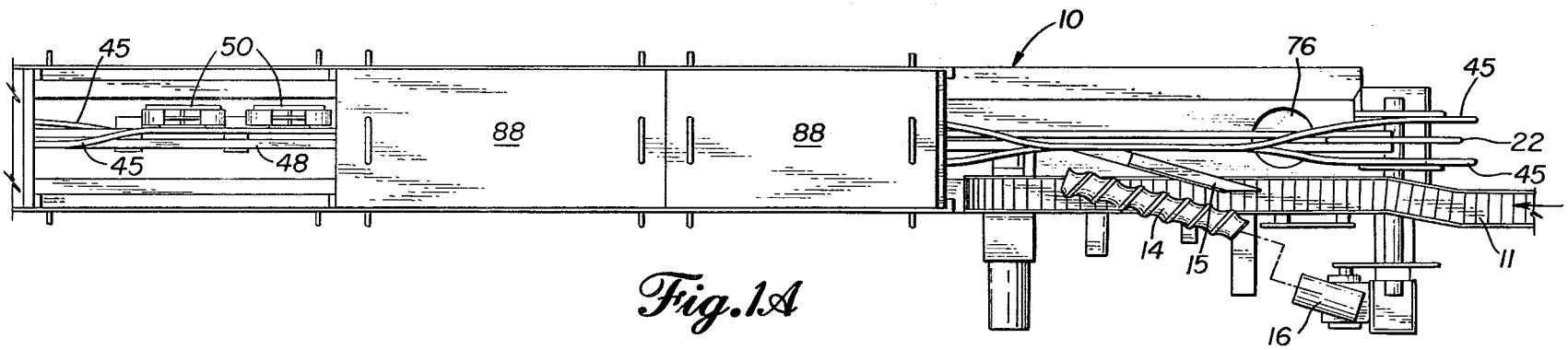
Figure 2A:
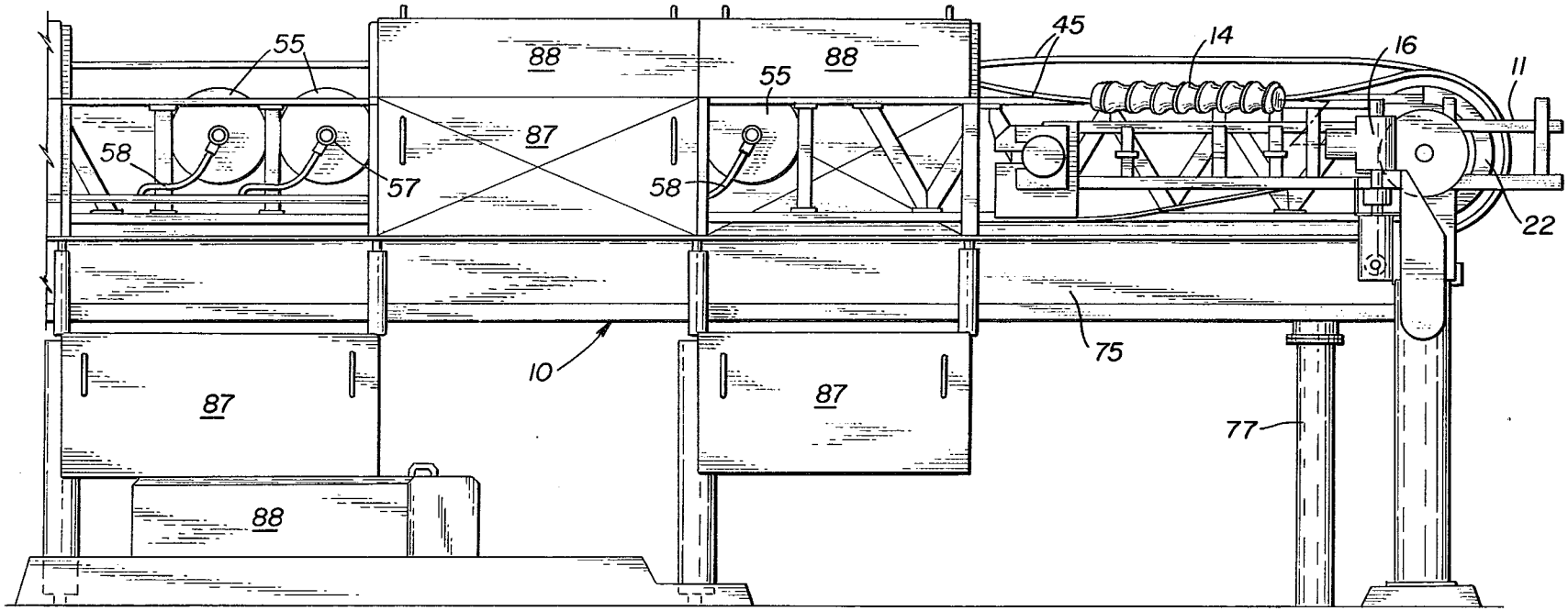

A trough 75 may underlie the nozzle manifold 50 for catching drained rinse liquid. In a rinser having a plurality of nozzle manifolds, for example six, those manifolds first spraying rinse liquid at the bottles may draw the liquid from a recycled supply. As shown in FIGS. 2 and 2A trough 75 is equipped with a drain 76 leading to a drain pipe 77 that leads to a rinse liquid storage tank (not shown). The first four nozzle manifolds draw rinse liquid from the storage tank, and the final two nozzle manifolds receive a fresh supply of rinse liquid, which drains into trough 75 from the rinsed bottles. Spray nozzles for rinsing the bottle exteriors may be located anywhere along the bottle path over trough 75, as is well known in the prior art.

The bottle carrying chain is kept under tension by a counterweight and lever assembly 79 that operates on an idler wheel 80 to tension the chain without reverse bending. The desired close bottle spacing achieved through the in-line feature of the rinser restricts reverse bending, and constant chain tension is also desired to assist in feeding the chain into the track 48, which runs along the straight path of the chain between sprocket wheels 22 and 23 both above and below the nozzle manifolds.

When the bottles 13 have passed over the nozzle manifolds and drained, they may be unloaded by unloading means such as timing screw 83 and guide rail 84, which operate similarly to timing screw 14 and guide rail 15 at the opposite end of the rinser 10. Timing screw 83 is connected by mechanical system 85 to operate in synchronization with bottle carrying chain 18, for example by connection to sprocket wheel 23. Timing screw 83 and rail 84 remove each bottle 13 from its carrier 27 on chain 18 and guide the bottle onto conveyor 12.

Figure 9:
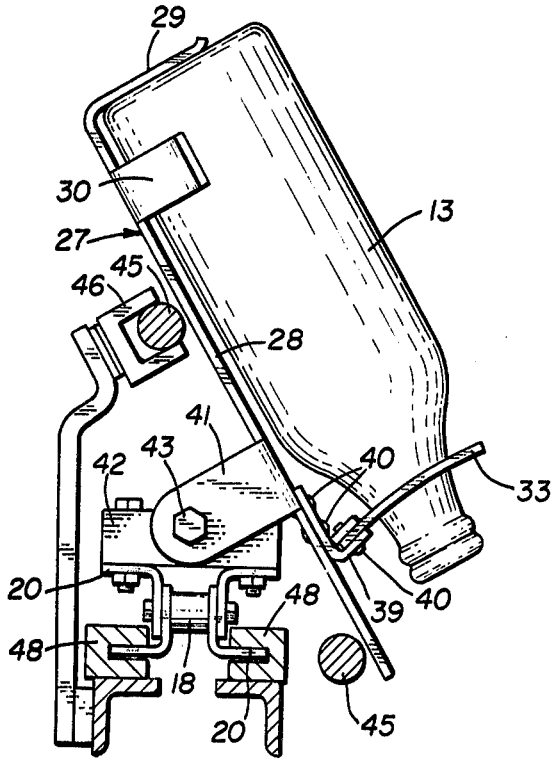
FIG. 9 is an elevational view showing the position of a bottle carrier and bottle in draining position.

In operation, conveyor 11 brings a supply of upright bottles to the loading means, which feeds each bottle 13 into a carrier 27 on a first side of chain 18, as shown in FIG. 7. As soon as the bottle is in its carrier, guide rods 45 may begin to invert the carrier and bottle, for example by bringing the lower end of the carrier up and over chain 18 until the bottle is inverted on a second and opposite side of chain 18, as shown in FIG. 8. While in inverted position, the bottle passes over the nozzle manifold 50 shown in FIG. 5, where each bottle is sprayed by a jet of rinse liquid as it travels in the plane of nozzle rotation. The jet of liquid enters the mouth of the bottle through a varying angle as the bottle moves over the manifold and the nozzle follows the bottle mouth as the nozzle passes through the spray arc. The varying angle of spray creates swirling action that is exceptionally effective for rinsing both the sides and bottom of the bottle interior, and the varying angle of spray also eliminates points of stagnation found with rinsers that spray at a fixed angle. The bottle drains after the nozzle enters the nonspray arc and may be subjected to repeated rinsing and draining by additional nozzle manifolds along the path of the chain 18. After being rinsed, the bottles pass onto a draining area where guide rods 45 may tilt the carrier to a predetermined angle, for example 30 degrees as shown in FIG. 9, to aid in draining residual rinse liquid. Guide rods 45 may then return the bottle to upright position for unloading by the unloading means. The chain 18 with empty carriers 27 travels around sprocket wheel 23 and idler wheel 80, then under the rinse means to sprocket wheel 22, and finally around wheel 22 into position to receive bottles.

The entire rinsing process from loading to unloading may take place as chain 18 carries the bottle along a straight path with the bottle being inverted and returned to upright position by pivoting over the top of the chain in response to the configuration of guide rods 45 acting on carrier 27. The bottles may be more closely spaced than with conventional rinsers because the in-line structure requires no extra space between bottles to allow for bends in the chain. Similarly, the in-line arrangement allows the carried bottles to be supported on the chain at a mechanically desirable point for balance and minimal stress on the chain, carrier, and guide rods. All bending in chain 18 takes place where no bottles are present in carriers, for example immediately before loading bottles as the chain passes around sprocket wheel 22. Guide rods 45 may position the empty carriers as needed to avoid interference as the chain passes around sprockets 22 or 23.

The in-line construction of the rinser allows ready access for inspection and maintenance. The sides of the rinser above trough 75 may be covered by easily removable inspection panels 87 and the top of the rinser may be enclosed by removable transparent covers 88.

It should be understood that within the scope of this invention the term bottle may apply to jars and other like containers. Also, the described bottle carriers and guide means may be substantially varied to include other structures that invert a carried bottle as the conveyor upon which they may be mounted continues in a substantially straight path. The advantages of the described chain and carriers may be applied to operations other than rinsing. For example, in a beverage production line, the bottle carrying means cold efficiently empty improperly filled containers and route the containers to be rinsed and refilled.

I claim:

1. The method of rinsing bottles, comprising in the order stated:

(a) loading upright bottles into carriers on a conveyor chain traveling in a substantially straight path, (b) inverting the bottles by pivoting their carriers in a plane perpendicular to the path of the conveyor chain, the carriers retaining the bottles in defined position with respect to the carriers, (c) spraying rinse liquid into the moving bottles through a varying angle as the inverted bottles approach, pass over, and travel beyond spray means along said straight path, (d) returning the bottles to upright position by pivoting their carriers in a plane perpendicular to the path of the conveyor, and (e) unloading upright bottles from the carriers, the loading, inverting, spraying, uprighting, and unloading taking place along said straight path.

2. The method of claim 1, further comprising after step (c) above pivoting said bottle carriers to an acute angle from inverted position and moving the carriers linearly along said straight path for a predetermined distance to aid in efficient draining of rinse liquid from the bottles.

3. A rinser for bottles and the like, comprising conveyor means having a substantially in-line path for a portion of its travel and having a plurality of bottle carriers attached thereto by a mounting pivotable in a plane non-parallel to the conveyor path; loading means placing bottles from an external source in said carriers; guide means pivoting the carriers and contained bottles about said pivotal mounting without direct bottle contact, the bottles remaining in a defined position with respect to their carriers; rinse means spraying the pivoted bottles with rinse liquid; and unloading means removing the rinsed bottles from the carriers; said loading means, guide means, rinse means, and unloading means operating along said in-line path of the conveyor means.

4. An in-line rinser for bottles and the like, comprising:

(a) an endless bottle conveyor chain having a plurality of bottle carriers connected to the chain by a pivotal mounting and having a substantially straight path for a portion of its travel, said carriers being pivotable on said mountings in a plane non-parallel to the straight path of the chain;

(b) loading means synchronized with said conveyor chain and feeding bottles from an external supply into said carriers, (c) guide means pivoting said carriers and their contained bottles in a plane substantially perpendicular to the straight path of said conveyor chain without directly contacting the bottles to avoid abrasion damage, the carriers retaining the bottles in defined relative position throughout the pivoting motion, (d) rinse means spraying the pivoted bottles within said carriers with rinse liquid, and (e) unloading means synchronized with said conveyor chain and removing the rinsed bottles from the carriers and directing them to an exterior point, said loading means, guide means, rinse means, and unloading means operating along said straight path of the chain.

5. The rinser of claim 4, wherein said conveyor chain comprises a lug chain and said pivotal mountings comprise pivot blocks mounted on said lugs.

6. The rinser of claim 4, wherein at least one of said bottle carriers further comprises a stamped and formed portion and an elastomer retainer portion, the stamped and formed portion having a lengthwise member, a bottom member and a side arm for supporting a carried bottle and having a pivot arm for attaching the carrier to said chain; and said elastomer retainer portion having a central hole for receiving a bottle neck and a front opening allowing access to the central hole; and connecting means attaching the elastomer retainer portion and the stamped and formed portion.

7. The rinser of claim 6, wherein said connecting means attaching the elastomer retainer portion of said bottle carrier to the stamped and formed portion angles the retainer downwardly at an acute angle from perpendicular to said lengthwise member for urging a bottle into the carrier and assisting in retaining the bottle.

8. The rinser of claim 4, wherein said guide means comprises a guide rod generally following the straight path of the conveyor chain in spaced relationship relative to the sides of the chain, a portion of the guide rod having a helical pattern for prompting the bottle carrier to pivot about the chain on said pivotal mounting in response to said helical pattern, and another portion of the guide rod having a generally straight configuration for urging the carrier to travel linearly without pivotal motion about the chain.

9. An in-line rinser for bottles and the like comprising:

(a) a conveyor carrying a succession of bottles in predetermined locations with respect to the length of the conveyor;

(b) spray means for spraying rinse liquid into passing bottles on the conveyor through an angle that varies with respect to each bottle;

(c) said spray means comprising a circular rotatable nozzle manifold with a plurality of spray nozzles mounted in its circumferential edge, synchronizing means connected to the conveyor for rotating the manifold through a spray arc in response to the passage of said predetermined bottle locations of the conveyor, and means delivering a supply of rinse liquid to the manifold;

(d) sealing means covering a portion of the circumferential edge of said circular nozzle manifold; and (e) means for limiting radially outward movement of the nozzles with respect to said circular nozzle manifold but permitting the nozzles to be pushed radially inwardly by said sealing means.

10. The rinser of claim 9, wherein said sealing means comprises an arcuate seal ring covering a predetermined portion of said circumferential edge of the nozzle manifold and defining a non-spray arc, the seal ring sealing the nozzles as they pass through the non-spray arc but allowing the nozzles to spray when not passing therethrough.

11. The rinser of claim 9, wherein said nozzle manifold has a bore for each of said nozzles in the circumferential edge of the manifold, the nozzles being floatably mounted in said bore and extendable outwardly beyond the outward opening of the bore in the circumferential edge, and wherein said rinse liquid is constantly supplied under pressure to each nozzle throughout the entire rotation of the manifold, the pressure urging each nozzle outwardly in its bore for self-adjusting sealing contact against said sealing means.

12. The rinser of claim 11, wherein each nozzle further comprises an outer end having a seal ring contact face that includes an orifice for spraying rinse liquid, and an inner end having a greater projected area than said seal ring contact face at the outer end, the greater relative projected area of the inner end assuring self-sealing pressure of the nozzles against said sealing means.

13. In combination with a conveyor for bottles for use with bottle rinsing means, an improved bottle carrier characterized by the absence of springs and rollers, for use with a necked bottle of predetermined axial height and shape, comprising:

(a) a lengthwise member approximately parallel to and spaced from the vertical axis of a carried bottle and spaced from the side wall of the bottle;

(b) a bottom member substantially perpendicular to the lengthwise member and contacting at least a portion of the bottom of a carried bottle;

(c) a pair of side arms angling obliquely from said lengthwise member toward the carried bottle and contacting the side of the bottle; and (d) a flexible bottle neck retaining member connected to said lengthwise member and angling acutely toward said bottom member for urging a bottle into the carrier and assisting in retaining the bottle against said bottom and side members, said neck retaining member contacting the bottle between the finish and the bottom of the bottle for improved exposure of the finish to rinse liquid.

14. The carrier of claim 13, wherein said bottle neck retaining member is of elastomer material.

15. The carrier of claim 13, further comprising adjustable mounting means attaching said neck retaining member to said lengthwise member for adapting said carrier to accommodate a variety of predetermined bottle sizes.

16. The carrier of claim 13, further comprising a pair of pivot arms supported by said lengthwise member for attaching the carrier to said conveyor for bottles.

* * * * *